US010297236B1

(12) United States Patent
Steinberger

(10) Patent No.: US 10,297,236 B1
(45) Date of Patent: May 21, 2019

(54) UNIVERSAL CAPO FOR VARIETY OF INSTRUMENTS AND STRING GAUGES

(71) Applicant: D'Addario & Company, Inc., Farmingdale, NY (US)

(72) Inventor: Richard Ned Steinberger, Nobleboro, ME (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 16/171,435

(22) Filed: Oct. 26, 2018

Related U.S. Application Data

(60) Provisional application No. 62/577,940, filed on Oct. 27, 2017.

(51) Int. Cl.
*G10D 3/04* (2006.01)

(52) U.S. Cl.
CPC ..... *G10D 3/043* (2013.01)

(58) Field of Classification Search
CPC ..... G10D 3/043
See application file for complete search history.

(56) References Cited

U.S. PATENT DOCUMENTS

| | | | |
|---|---|---|---|
| 583,102 | A | 5/1897 | Utt |
| 656,904 | A | 8/1900 | Pletcher |
| 1,788,636 | A | 1/1931 | Russell |
| 2,496,191 | A | 1/1950 | Zipperstein et al. |
| 3,598,012 | A | 8/1971 | Dunlop |
| 3,647,930 | A | 3/1972 | Wowries |
| 3,722,346 | A | 3/1973 | Valentino |
| 3,823,247 | A | 7/1974 | Bauerfeind |
| 3,971,287 | A | 7/1976 | Ito |
| 4,048,894 | A | 9/1977 | Myerson et al. |
| 4,104,947 | A | 8/1978 | Oster |
| 4,128,034 | A | 12/1978 | Myerson et al. |
| 4,143,576 | A | 3/1979 | Nichols et al. |
| 4,183,279 | A | 1/1980 | Shabram, Jr. |
| 4,252,046 | A | 2/1981 | Myerson et al. |
| 4,301,705 | A | 11/1981 | Gould |

(Continued)

FOREIGN PATENT DOCUMENTS

| | | | |
|---|---|---|---|
| GB | 2030340 | A | 4/1980 |
| GB | 2184283 | A | 6/1987 |
| JP | 2010204400 | A | 9/2010 |

OTHER PUBLICATIONS

"How I Made a Metal Guitar Capo," http://dennishavlena.com/capo.htm with the affidavit of authenticity from Internet Archive, published Oct. 27, 2010.

*Primary Examiner* — Kimberly R Lockett
(74) *Attorney, Agent, or Firm* — Alix, Yale & Ristas, LLP

(57) ABSTRACT

A universal capo for use with a variety of stringed instruments and with a variety of gauged strings has an upper rigid arm extending longitudinally. A core block made from an elastomer with a first durometer is mounted to the rigid arm. A wrap layer made from an elastomer with a second durometer cradles the core block on the bottom and lateral sides and can extend over the top of the rigid arm. The second durometer hardness is at least 1.5 times the first durometer hardness and the core and wrap have thicknesses collectively contributing to a substantially even pressure on strings of varying gauges to effectively clamp the strings to the neck of an instrument without application of undue pressure.

21 Claims, 4 Drawing Sheets

(56) References Cited

U.S. PATENT DOCUMENTS

| | | | | |
|---|---|---|---|---|
| 4,304,165 | A | 12/1981 | Gould | |
| 4,319,512 | A | 3/1982 | Clybum | |
| 4,475,433 | A | 10/1984 | Williamson et al. | |
| 4,793,234 | A | 12/1988 | Geis | |
| 6,369,307 | B1 | 4/2002 | Wells | |
| D521,048 | S | 5/2006 | Steinberger | |
| 7,956,263 | B1 | 6/2011 | Volk, Jr. et al. | |
| 8,093,476 | B2 | 1/2012 | Vochezer | |
| 8,240,473 | B2 | 8/2012 | Van Patten | |
| 8,269,084 | B2 | 9/2012 | Ludwig | |
| 8,779,262 | B1 | 7/2014 | Steinberger | |
| 9,741,320 | B2 | 8/2017 | Stromberg | |
| 10,147,404 | B2 | 12/2018 | Campling | |
| 2009/0241752 | A1 | 10/2009 | Vochezer | |
| 2015/0107436 | A1* | 4/2015 | Dunlop ..... | G10D 3/043 84/318 |
| 2016/0247490 | A1 | 8/2016 | Campling et al. | |

* cited by examiner

UNIVERSAL CAPO FOR VARIETY OF INSTRUMENTS AND STRING GAUGES

BACKGROUND

The disclosure relates to music capos, which are typically clamped on the neck of stringed instruments to change the play length of the strings, thereby altering the sound.

Many kinds of stringed instruments are known, and capos can be used with numerous such instruments. However, for the purposes of the present disclosure, the background will be discussed and the inventive concepts will be described primarily with regards to guitars. Guitars fall into the three main categories of classical, folk, and electric. Due to several factors, capos are generally designed for use on one type of guitar. A capo configured primarily for one type of guitar is commonly less effective if used on other types of guitars. An effective capo presses down on all the strings between two frets, with enough force to change the play length while preventing unwanted vibration ("buzz"), but without excessively clamping so as to stretch any of the strings over the fret, which results in degradation of string and tuning issues.

One challenging design factor is the difference in string diameter (i.e., gauge) as among the thinner, higher pitch strings and the thicker, lower pitch strings. Classical guitar necks are generally flat, whereas the folk and electric guitars typically have a neck that is radiused in the range of about 7 to 20 inches. Different radii affect playability and the radius is a matter of the personal choice of the instrument designer and the type of player he is targeting. However, whether the neck is flat or radiused, a capo with a flat contact strip cannot easily accommodate all of the strings uniformly. Likewise, a capo with a contoured or radiused contact strip would be more effective for one type of guitar having a particular neck radius, but unsatisfactory for other guitars.

These design factors are especially significant for capos to be used on fretted instruments with strings in pairs. Instruments like twelve string guitars and mandolins, for example, have pairs of strings, some in unison and some tuned in octaves. A twelve string guitar has six courses, each with a side-by-side pair of strings. The top two strings are the same in diameter and pitch but the lower four pairs are tuned in octaves and string diameters are significantly different for each octave. A capo thus must be effective not only transversely across the entire neck, but for the pairs of octaves and those tuned in unison as well.

Efforts have been made to provide a capo that is effective for a wide range of guitar types without significant success. U.S. Pat. No. 4,793,234 (Geis) describes a capo having a rigid upper arm and a hydraulic bladder secured to the underside of the upper arm. U.S. Patent Application Publication No. 2016/0247490 (Campling) discloses a rigid upper arm with a rubber outer layer that encapsulates a rigid chamber and a flowable medium on three sides with a resilient spacer element between the fourth side.

It would be useful to have a capo that is effective on a wide range of string instrument and neck types as well as strings on a given instrument that have a broad range of gauges.

SUMMARY

Disclosed herein is a universally-effective capo with an upper rigid arm, a core block and a wrap layer. The rigid arm extends in a longitudinal direction and defines an upper surface and lower surface. The core block is mounted to the upper rigid arm and is made from an elastomeric material having a first durometer hardness. The core block extends longitudinally along the lower surface of the rigid arm and defines a bottom side and opposite lateral sides. The wrap layer is positioned around the bottom side and lateral sides of the core, and around the top surface of the rigid arm. The wrap layer is made from an elastomeric material with a second durometer hardness. The first durometer hardness of the core block is less than the second durometer hardness of the wrap, as measured on the Shore A hardness scale.

Another embodiment of the capo has an upper rigid arm extending in a longitudinal direction and defining an upper surface and lower surface. A core block is positioned beneath the rigid arm lower surface and has a first thickness $T_1$ measured from its top to bottom. The core block is made from an elastomeric material with a first durometer hardness. A wrap layer made from an elastomeric material is around the core block and defines a string contacting surface beneath the core block. The string contacting surface has a second thickness $T_2$ and the elastomeric material of the wrap has a second durometer hardness. The ratio of the second durometer hardness to the first durometer hardness is at least 2:1, as measured on the Shore A hardness scale, and the ratio of the first thickness to the second thickness ($T_1$:$T_2$) is at least 2:1.

In yet another embodiment, a universal capo has an upper rigid arm, a core block and a wrap layer. The upper rigid arm extends in a longitudinal direction and defines an upper surface and lower surface. The core block is beneath the rigid arm lower surface and made from an elastomeric material having a first durometer hardness. A wrap layer cradles the core block to the rigid arm and defines a string contacting surface beneath the core block. The wrap layer is made from an elastomeric material having a second durometer hardness. The first durometer hardness of the core block is within the approximate range of 5 A-25 A and the durometer hardness of the wrap is within the approximate range of 20 A-60 A, as measured on the Shore A hardness scale. The ratio of the second durometer hardness to the first durometer hardness within the approximate range of 2:1 to 6:1.

To enhance the universality of the capo, versions can include a fine adjustment to set the precise amount of required tension to hold the strings against the frets without pulling them out of tune.

The superior universality arises from a combination of the cooperative hardness and thickness properties of the core and wrap. The functioning depends significantly on the ability of the softer inside rubber to squeeze or bulge out in a lateral direction to allow the higher strings to push up into the rubber without undue resistance and provide an evenness in the pressure on all clamped strings; essentially mimicking the function of the human finger fretting an instrument string. Further advantages are achieved, in part, from a nearly flat contact surface of string contacting surface, which is not pre-radiused for accommodating a particular neck radius. However, the advantage of the invention relative to known capos can also be realized with a blade assembly that is partially or fully radiused.

Both the core block and wrap are preferably formed of an elastomer, for example silicone rubber. The core can be within a range of hardness that generally mimics the fleshy feel of a human finger, with a surrounding wrap layer that is significantly harder, like a human finger skin.

As an illustrative example, in a particularly effective configuration, the core block has a Shore A hardness in the range of 10+/−5 and the lower/outer layer is in the range of 40+/−10. A range of 5-25 for the core and 20-60 or more for the wrap layer can be effective if coordinated with the relative thicknesses. Preferably, both layers should exhibit a Shore hardness difference of at least about 10 Shore units, especially in a ratio of at least 2:1.

BRIEF DESCRIPTION OF THE DRAWINGS

Preferred embodiments of the disclosed universal capo are described herein with reference to the accompanying drawings, wherein like numerals represent like elements throughout, in which.

DETAILED DESCRIPTION

In addition to the benefits and improvements disclosed herein, other objects and advantages of the disclosed embodiments will become apparent from the following wherein like numerals represent like parts throughout the several figures. Detailed embodiments of a universal capo for use with a variety of stringed instruments and string gauges are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrase "in some embodiments" as used herein does not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

The Figures show a particular style of capo that clamps to an instrument neck via threading of a screw that causes actuation of a lower arm toward an upper arm to trap the instrument neck therebetween with the upper arm clamped against the strings. It must be noted that the inventive concepts disclosed herein can be readily incorporated into the upper string clamping arm of capos of any style and having actuating mechanisms, including, for example spring and band clamping capos. The actuating mechanisms simply provide means for moving the respective arms toward each other and clamping the arms onto the neck of a stringed instrument with the blade assembly pressed against the instrument strings, including fine adjustment of the force and thus the applied pressure against the strings.

Figure 1:
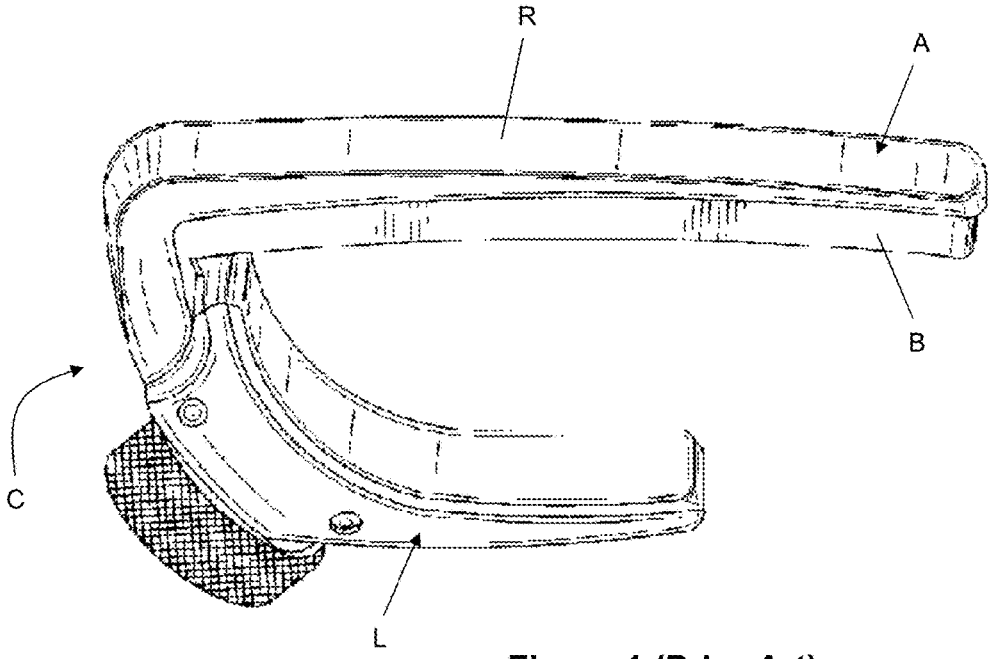
Figure 1 (Prior Art)
FIG. 1 shows a version of a capo as known in the prior art.

As shown in FIG. 1, the prior art capo C includes an upper arm A spaced from a lower arm L. The upper arm A includes a rigid arm R with a blade B, typically made from a resilient material, mounted on the inner surface of the rigid arm R for contacting the strings and holding them against the instrument neck.

Figure 2:
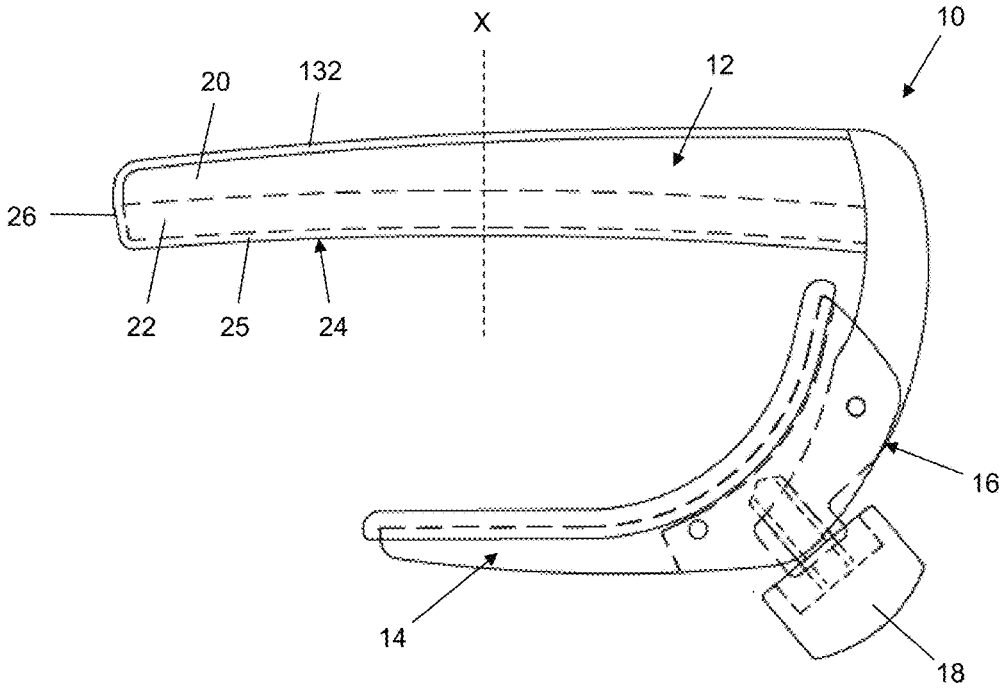
FIG. 2 shows a preferred embodiment of the inventive capo of the disclosure in a side partial sectional view.

As shown in FIG. 2, the preferred embodiment of the disclosed capo 10 includes many of the same elements as the prior art capo of FIG. 1. For instance, the capo 10 includes an upper arm 12 spaced from a lower arm 14 joined to one another at one or more hinge connections 16 and an actuating screw 18. The upper arm 12 comprises a rigid arm 20 with a first core block 22 mounted directly on the lower surface of the rigid arm and an elastomeric wrap 24 cradling the core block 22. An important characteristic of the capo 10 concerns the hardness properties of the material of the core block 22 and the elastomeric wrap 24, and more importantly the respective hardness properties of the core and wrap, to one another, as will be discussed in detail below. This preferred embodiment of the capo 10 includes an elastomeric wrap 24 that is formed around all sides of the core blade 22 and rigid arm 20, including the bottom string contacting section 25, longitudinal front end 26, lateral sides 28 and 30, and over the top 32 of the rigid arm. Additional embodiments exist wherein the elastomeric wrap 24 is formed only partially around these elements or portions of elements.

Figure 3:
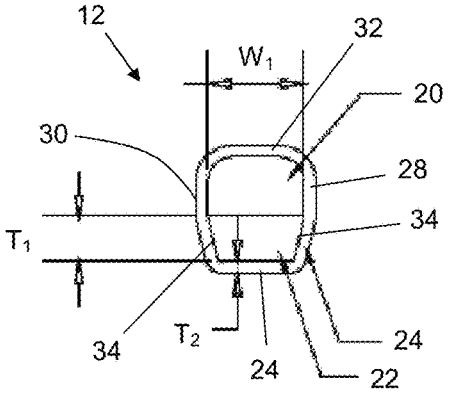
FIG. 3 shows the upper arm element of the capo of FIG. 2 in cross section with various dimensions illustrated.

FIG. 3 shows a cross section of the upper arm 12 through a plane shown in FIG. 2 as reference X with preferred dimensions of key elements. Particularly, dimensions depicted include the following:

- Thickness of core blade 22 from top to bottom ($T_1$): approximately 0.05-0.25 inches, more preferred approximately 0.125 inches.
- Thickness of elastomeric wrap 24 ($T_2$): approximately 0.01-0.10 inches, more preferred approximately 0.03 inches.
- Lateral width of rigid arm 20 ($W_1$): approximately 0.125-0.375 inches, more preferred approximately 0.125 inches.

In the inventive capos, including the capo 10 of FIGS. 1 and 2, the durometer of the elastomeric wrap 24 is significantly harder than the durometer of the core block 22, as measured on the Shore A hardness scale. Preferably the core block 22 is a relatively soft inner layer that is attached directly to the rigid arm 20 and cradled by the wrap 24 to yield a "sandwiched" configuration between the rigid arm and the lower section of the wrap. The block 22 may define as relatively rectangular prismic shape or, in the case of the preferred embodiment of FIG. 3 have moderately tapered lateral side surfaces 34 to take on a trapezoidal prismic form. The wrap 24 is formed of an elastomer that preferably wraps around the entire core block 22 and rigid arm 20 to cradle the core 22 along the longitudinal extent of the core. Formation of the wrap 24 can be accomplished via a variety of manufacturing techniques, including over-molding, force fit, or combination of force fit and adhesive, for example. As shown in FIGS. 2 and 3, the core block 22 has a top portion that is substantially coextensive with the rigid arm 20 and lies below the rigid arm.

The wrap 24 together with the softer elastomeric core 22 form a resilient blade assembly with a flat (or optionally radiused, depending on design preferences) bottom string contacting surface and material properties allowing it to expand laterally (i.e., bulging) under a force acting against the bottom surface 25 toward the rigid arm 20 that causes longitudinal displacement of the string contacting surface of the wrap. The squeezing or bulging out of the lateral sides allows strings of larger diameters to push up into the elastomeric material without undue resistance. Likewise, this material displacement characteristic means that the capo 10 can accommodate a radius on the instrument neck that varies from the radius of the capo. For example, if one uses a capo with a radius on a flat fingerboard without any radius, the outside strings will need to push up higher into the wrapped core material in order for the capo to provide the necessary pressure to hold down the inner strings. By allowing the core 22 to bulge out the lateral sides beyond nominal width of the core 22 (i.e., width of the core when unclamped or "relaxed"), and optionally beyond the lateral width $W_1$ of the rigid arm 20, the larger diameter strings can be accommodated along with the smaller diameter strings more readily without requiring undue pressure on any string. Since the soft elastomeric core block 22 is mounted directly on the lower surface of the rigid arm 20, the rigid arm provides firm resistance to contribute to the core 22/wrap 24 relationship and assist an even lateral expansion of the core 22 to provide substantially even pressure on each individual string, regardless of its gauge, without overtightening any of them. As used herein, especially with respect to the core block with angled sides, "nominal width" references the width measurement between the opposite sides at any common vertical position of the sides when the capo is unclamped and relaxed.

The disclosed configuration of the capo 10 allows clamping each string with the minimum pressure required to prevent it from vibrating or "buzzing" against the fret. This minimizes unwanted pitch change created by the capo. Allowing the core material to be displaced both laterally and longitudinally provides the best results toward equalizing the pressure on all the strings. The pressure against the strings toward the fret board is most important consideration; the length of the rubber contact with the string is not a significant factor.

Figure 6:
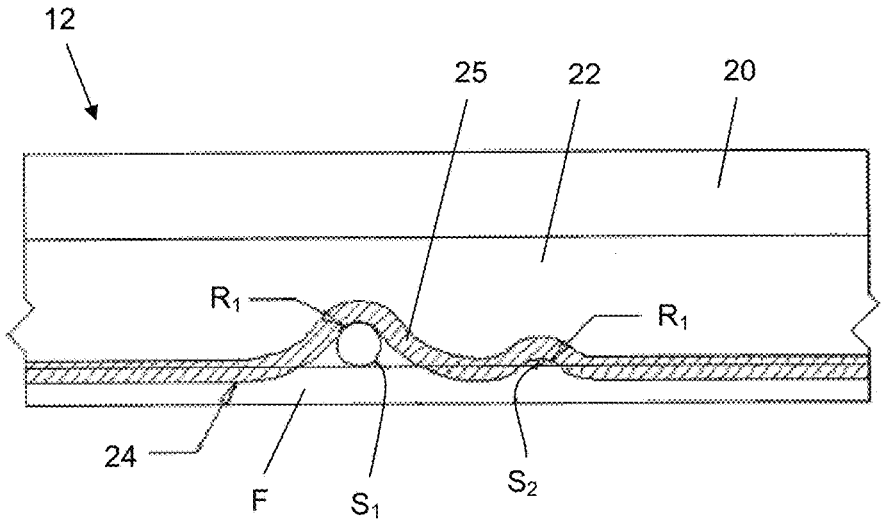
FIG. 6 is a view of the upper arm element of the embodiment of FIG. 2 in use.

The thickness and hardness properties of the core block 22 and wrap 24 combine to contribute significantly to the minimum radius that can be formed. The preferred combination allows a minimum radius of just slightly larger than the radius of the largest string, which allows the capo 10 to clamp the larger and smaller strings with a similar amount of force. If the minimum radius is too small (typically caused by a wrap that is too hard and/or too thick or a core that is too hard), then the thin strings will push up into the rubber more easily than the thick strings. If the minimum radius is too large (typically caused by a wrap that is too soft and/or too thin or a core that is too soft or too thin), then the blade will not be able to conform to the different diameters of the adjacent strings on a twelve string guitar. FIG. 6, which shows an enlarged side elevation view of a portion of the upper arm 12 clamped against a neck of a guitar maintaining a large gauge string $S_1$ and a small gauge string $S_2$ against a fret F, illustrates this aspect of the capo 10. As shown, the combination of the wrap 24, core 22 and rigid arm 20 allow an appropriate deformation for each of the exemplary strings of substantially diverse gauge sizes, $S_1$ and $S_2$, and without the deformation of the wrap and core caused by one string to impact the even clamping of the other string. Not seen in the side view of FIG. 6 is the lateral displacement of the core 22 and wrap 24 (bulge), which is in the directions into and away from the plane of the page in the depicted view.

In the preferred embodiment of FIGS. 1 and 2, the core 22 has a Shore A hardness in the range of approximately 5-25, preferably approximately 10-20, and more preferably approximately 10. The wrap 24 has a higher Shore A hardness value than the core in any given embodiment, and is within the range of approximately 20-60, preferably approximately 30-50, and more preferably approximately 40.

The ratio of the hardness of the wrap 24 to the hardness of the core 22 is typically above approximately 1.5:1, preferably above approximately 2:1, even more preferably above approximately 3:1, or within the approximate range of 1.5:1 to 12:1, more preferably within the approximate range of 2:1-6:1, more preferably within the approximate range of 3:1-5:1, and even more preferably approximately 4:1.

In the preferred embodiment depicted in FIGS. 1 and 2, the durometer of the wrap 24 is approximately 40 A and the durometer of the core block 22 is approximately 10 A, yielding a wrap:blade hardness ratio of approximately 4:1.

In the preferred embodiment, the ratio of the thickness $T_1$ of the core 22 to the thickness $T_2$ of the wrap 24 is typically above approximately 1.5:1, preferably above approximately 2:1, even more preferably above approximately 3:1, or within the approximate range of 1.5:1 to 12:1, more preferably within the approximate range of 2:1-6:1, more preferably within the approximate range of 3:1-5:1, and even more preferably approximately 4:1.

The most preferred configuration includes a core 22 and wrap 24, wherein the thickness ratio ($T_1$:$T_2$) and hardness ratio (wrap 24:core 22) is the same, each ratio being approximately 4:1. These ratios have shown to have shown particularly serendipitous results within the disclosed capo 10. In other variations, the thickness and hardness ratios can be adjusted, such as for example, a slightly harder wrap can be combined with a softer core to yield an effective universal capo. In another variation, a harder wrap can be formed thinner.

Figure 4:
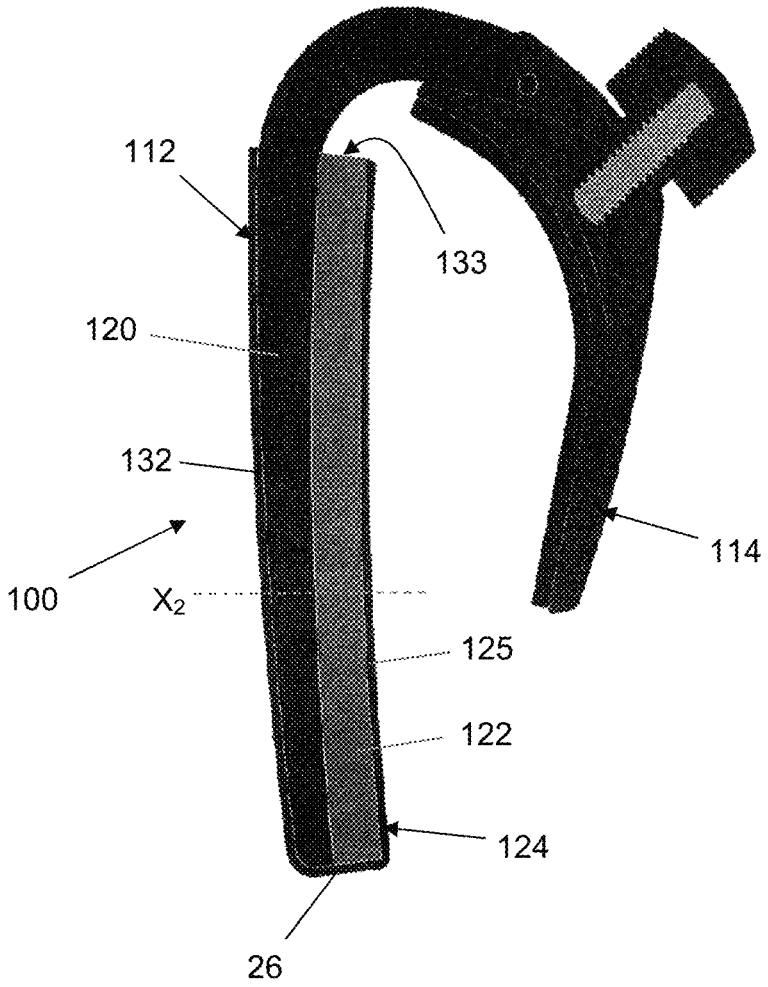
FIG. 4 shows a different embodiment of the disclosed capo in a partial cross sectional view.
Figure 5:
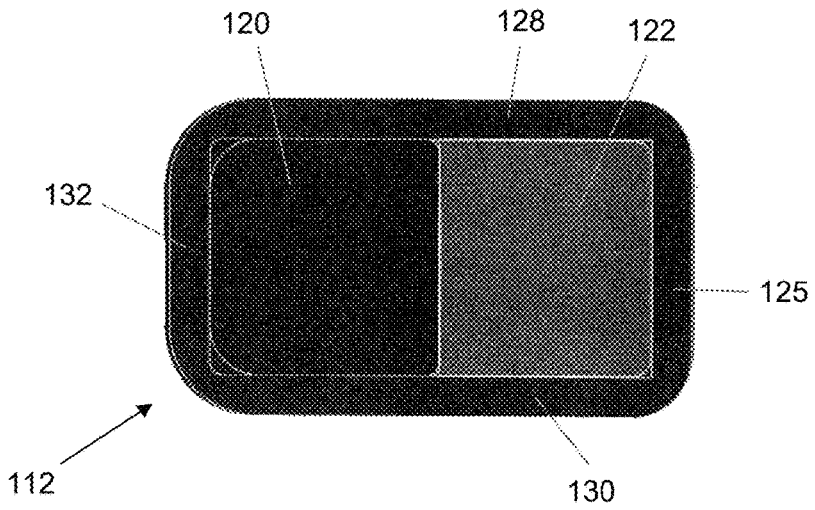
FIG. 5 shows the upper arm element of the capo of FIG. 4 in cross section.

FIGS. 4 and 5 show another embodiment of the universal capo 100. A longitudinally extending, rectilinear core block 122 is formed of relatively softer elastomeric solid material, such as silicone rubber, for example, and adhered directly to the bottom of the rigid arm 120. Like the previous embodiment, a wrap layer 124 of relatively harder elastomeric material, which can also be silicone rubber is formed around the core 122. This embodiment of the capo 100 varies from the embodiment of the capo 10 described above in that the proximal longitudinal end 133 of the core 122 is not restricted by a portion of the wrap 124 or by abutting into a portion of the rigid arm 120. Further, in this embodiment, the core 122 takes a more standard rectangular prismic shape as opposed to the trapezoidal prismic shape of the core 22 of the capo 10. Like the previous embodiment, the wrap comprises a lower layer 125 and opposite lateral sidewalls 128 and 130 that contain the core 120 while allowing flexure to accommodate clamped strings, and a top layer 132 molded around the rigid arm 120.

As shown in FIG. 5, the rigid arm 120 has a lateral width and the core 122 is rectangular prismic with a nominal width when unclamped that is substantially the same as the rigid arm width. In a deployed, clamped condition of the capo 100, on the neck of a stringed instrument against all of the strings, the core 122 bulges laterally beyond the nominal width, which allows the lower layer 125 of blade to effectively clamp all strings against the instrument neck without applying excessive pressure.

Embodiments of the capo 10 and 100 have been tested against a commercially available capo that has a multi-component blade ("Control Capo"). Capos 10 that were tested had a core 22 made of a solid silicone rubber material having a 10 A durometer and a wrap 24 made of silicone rubber having a 40 A durometer, on the Shore A hardness scale. The approximate configuration and dimensions of the tested capo 10 are consistent with those shown and described with respect to FIG. 2 with the wrap 24 formed around the bottom and sides of the core 22, and around the sides and top of the rigid arm 20. The front end of core 22 and rigid arm 20 are also covered with a layer of the wrap material 24. The inventive capo 10 and Control Capo were installed one after the other at the same location on the same twelve-string guitar, with the minimum force sufficient to eliminate buzzing against the fret.

As discussed above, an indicator of effectiveness of a capo is the ability to change the play length (pitch) of each string without stretching the string to the extent that the relative pitch is audibly affected. Once a guitar is tuned without a capo, the musician wants to avoid having to re-tune after the capo is applied. The performance characteristics of the capo 10 were compared to the Control Capo by several skilled musicians on the twelve-string guitar. The musicians heard noticeable pitch changes after using the Control Capo, whereas no noticeable pitch change was heard with the capo 10 according to the disclosure. Similar comparative tests have been run using guitars of different types with varying neck radii and shown the capo 10 to be effective across a wide range of instruments. Musicians consider these results for the universal capo 10 to be exceptionally effective.

As described herein, a preferred elastomeric material for forming the core block and wrap is a silicone rubber. However, other known elastomeric materials can be substituted for one or both of these elements without departing from the scope of invention.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A capo for clamping to the neck of a stringed musical instrument, comprising:

an upper rigid arm extending in a longitudinal direction and defining a upper surface and lower surface;

an core block mounted to the upper rigid arm, the core block being made from an elastomeric material having a first durometer hardness, the core block extending longitudinally along the lower surface of the rigid arm and defining a bottom side and opposite lateral sides;

a wrap layer around the bottom side and lateral sides of the core, and around the top surface of the rigid arm, the wrap layer being made from an elastomeric material having a second durometer hardness, wherein the first durometer hardness is less than the second durometer hardness as measured on the Shore A hardness scale.

2. The capo of claim 1, wherein the core block extends longitudinally to a distal end and the wrap covers the distal end.

3. The capo of claim 1, wherein the ratio of the second durometer hardness to the first durometer hardness is at least 1.5:1.

4. The capo of claim 3, wherein the ratio of the second durometer hardness to the first durometer hardness is within an approximate range of 1.5:1 to 12:1.

5. The capo of claim 4, wherein the ratio of the second durometer hardness to the first durometer hardness is within an approximate range of 2:1-6:1.

6. The capo of claim 5, wherein the ratio of the second durometer hardness to the first durometer hardness is approximately 4:1.

7. The capo of claim 1, wherein the core block has a nominal width between the opposite lateral sides when in a relaxed position not attached to a stringed instrument, and the core block and wrap are configured to allow the core block to bulge laterally outward beyond the nominal width in response to pressure P applied to the wrap at the bottom in the direction toward the rigid arm.

8. The capo of claim 1, wherein the core block has a thickness $T_1$ and the wrap has a thickness $T_2$ that is less than $T_1$.

9. The capo of claim 3, wherein the durometer hardness of the core block is within an approximate range of 5-25 A and the durometer hardness of the wrap is within an approximate range of 20-60 A, as measured on the Shore A hardness scale.

10. The capo of claim 9, wherein the durometer hardness of the core block is within an approximate range of 10-20 A and the durometer hardness of the wrap is within an approximate range of 30-50 A, as measured on the Shore A hardness scale.

11. The capo of claim 10, wherein the durometer hardness of the core block is approximately 10 A and the durometer of the wrap is approximately 40 A, as measured on the Shore A hardness scale.

12. The capo of claim 1, wherein core block has a thickness $T_1$ and the wrap has a thickness $T_2$, and wherein the ratio of the second durometer hardness of the wrap to the first durometer hardness of the core block is at least 1.5:1, the durometer hardness of the core block is within the approximate range of 5 A-25 A as measured on the Shore A hardness scale, the durometer hardness of the wrap is within the approximate range of 20 A-60 A as measured on the Shore A hardness scale, the ratio of $T_1$ to $T_2$ is within the approximate range of 2:1 to 6:1.

13. The capo of claim 12, wherein when the capo is clamped on the neck of a guitar having strings of different gauges against all of the guitar strings, the wrap layer that contacts the strings deforms around each string with a radius of curvature that is substantially the same for each string.

14. The capo of claim 1, wherein the core block has a trapezoidal prismic shape wherein opposite lateral sides transition inward from the bottom surface of the rigid arm toward the bottom side of the core block.

15. The capo of claim 5, wherein the durometer hardness of the wrap and the durometer hardness of the core block differ by at least 10 units as measured on the Shore A hardness scale.

16. A capo for clamping to the neck of a stringed musical instrument, comprising:

an upper rigid arm extending in a longitudinal direction and defining a upper surface and lower surface;

an core block beneath the rigid arm lower surface, the core block having a first thickness $T_1$ measured from its top to bottom and being made from an elastomeric material having a first durometer hardness;

a wrap layer around the core block cradling the core block to the rigid arm, the wrap layer defining a string contacting surface beneath the core block and being made from an elastomeric material having a second durometer hardness, the string contacting surface having a second thickness $T_2$, wherein the ratio of the second durometer hardness to the first durometer hardness is at least 2:1, as measured on the Shore A hardness scale, and the ratio of the first thickness to the second thickness ($T_1$:$T_2$) is at least 2:1.

17. The capo of claim 16, wherein the ratio of the second durometer hardness to the first durometer hardness and the ratio of the first thickness to the second thickness are approximately equal.

18. The capo of claim 16, wherein when the capo is clamped on the neck of a guitar having strings of different gauges against all of the guitar strings, the string contacting surface deforms around each string with a radius of curvature that is substantially the same for each string.

19. A capo for clamping to the neck of a stringed musical instrument, comprising:

an upper rigid arm extending in a longitudinal direction and defining a upper surface and lower surface;

an core block beneath the rigid arm lower surface, the core block being made from an elastomeric material having a first durometer hardness;

a wrap layer cradling the core block to the rigid arm, the wrap layer defining a string contacting surface beneath the core block and being made from an elastomeric material having a second durometer hardness, wherein the first durometer hardness of the core block is within the approximate range of 5 A-25 A and the durometer hardness of the wrap is within the approximate range of 20 A-60 A, as measured on the Shore A hardness scale, and the ratio of the second durometer hardness to the first durometer hardness within the approximate range of 2:1 to 6:1.

20. The capo of claim 19, wherein the core block has a first thickness $T_1$ measured from its top to bottom, the wrap has a second thickness $T_2$, and the ratio of the first thickness to the second thickness ($T_1$:$T_2$) is at least 2:1.

21. The capo of claim 19, wherein the core block has a nominal width between opposite lateral sides when in a relaxed position not attached to a stringed instrument, and when a pressure P is applied at the string contacting surface of the wrap in the direction toward the rigid arm, the core block bulges laterally outward beyond the nominal width.

* * * * *